United States Patent [19]

Wiley

[11] 3,950,069

[45] Apr. 13, 1976

[54] ELECTRICAL ANGLE PLUG

[75] Inventor: Roy O. Wiley, Huntington, Conn.

[73] Assignee: Westinghouse Electric Corporation, Pittsburgh, Pa.

[22] Filed: Dec. 10, 1974

[21] Appl. No.: 531,427

[52] U.S. Cl. ..... 339/196 M; 339/206 P

[51] Int. Cl.[2] ..... H01R 13/58; H01R 33/06

[58] Field of Search ..... 339/103, 107, 196, 206, 339/208

[56] References Cited

UNITED STATES PATENTS

| | | | |
|---|---|---|---|
| 3,392,362 | 7/1968 | Lipinski | 339/196 M |
| 3,718,890 | 2/1973 | Sheldon | 339/107 |
| 3,747,049 | 7/1973 | Cressman et al. | 339/107 |
| 3,760,338 | 9/1973 | Bruels | 339/107 |

*Primary Examiner*—Roy Lake
*Assistant Examiner*—Neil Abrams
*Attorney, Agent, or Firm*—G. H. Telfer

[57] ABSTRACT

An angle plug including a base member with contact elements and terminals, a cover member with a lateral access port for a cable to be admitted and joined to the terminals, and a cylindrical ring member slidably fit over a portion of the base and longitudinally abutting a second portion of the base and also the cover. Fastener apertures extending through the base are selectively oriented with any of numerous threaded apertures within a chamber of the cover to provide angular orientation in numerous positions without otherwise requiring mating engagement of the cover with respect to the base.

5 Claims, 3 Drawing Figures

ELECTRICAL ANGLE PLUG

BACKGROUND OF THE INVENTION

This invention relates to wiring devices and particularly to electrical angle plugs.

It has long been realized that it is frequently desirable to have an electrical plug whose blades are oriented at substantially 90° from the direction in which the electrical cord extends from the plug housing so that the cord is not as subject to damage in use. A variety of angle plug configurations have been used or proposed. See, for example, U.S. Pat. Nos. 1,984,181; 2,425,679; 2,869,102; 3,137,536; 3,335,395; and 3,747,049. Improvements are desirable in the variety of angular positions that are available and in the simplicity of construction.

SUMMARY OF THE INVENTION

In accordance with this invention, an angle plug is provided including a base member with contact elements and terminals secured in it, a cover member with a lateral access port for a cable to be admitted and joined to the terminals, and a cylindrical ring member slidably fit over a portion of the base and longitudinally abutting a second portion of the base and also the cover. Fastener apertures extending through the base are selectively oriented with any of numerous threaded apertures within a chamber of the cover to provide angular orientation in numerous positions without otherwise requiring mating engagement of the cover with respect to the base.

The angle plug of this invention is useful with otherwise standard base members, that is, base members whose design permits them to be also used for plugs that do not have the angle feature. The large number of angular orientations is made possible by having a continuous arcuate array of fastener apertures within the cover for mating with fasteners extending through the base apertures. Because the relative angular orientation of the elements is fixed solely by the fastener locations, there is no criticality in the configuration of the plug members themselves. The ring member is not locked against rotation with respect to either the base or cover but merely slidably fits around part of the base and is longitudinally disposed between the cover and base.

THE DRAWINGS

PREFERRED EMBODIMENT

Figure 1:
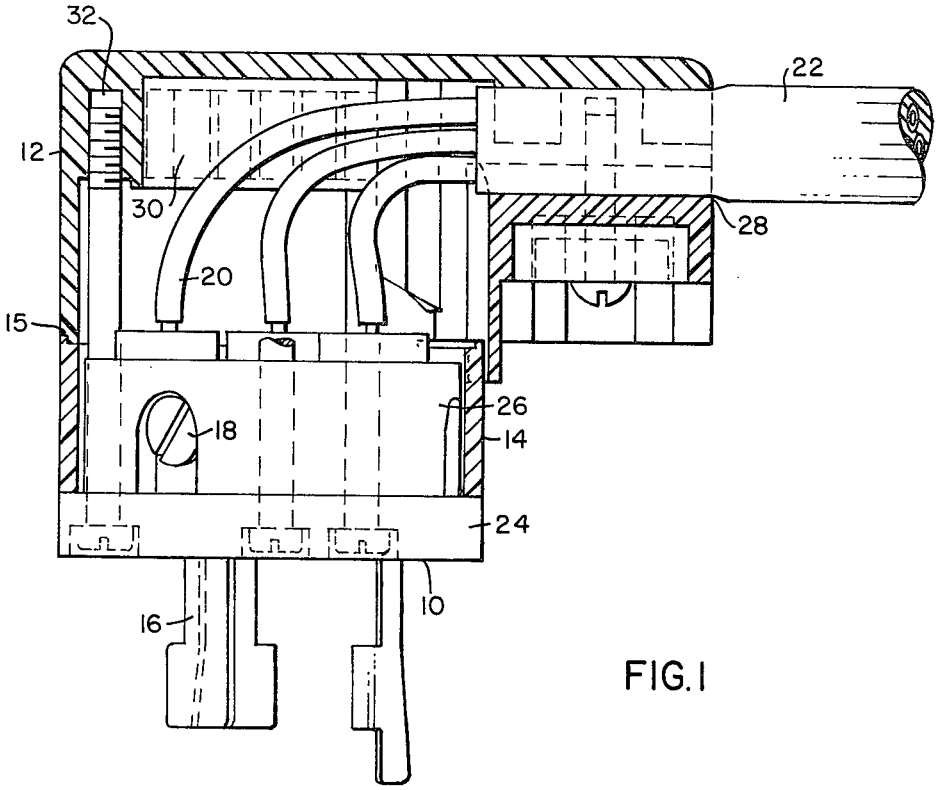
FIG. 1 is a side-elevation view of an angle plug in accordance with one embodiment of the present invention.

Referring to the drawing, there is shown an angle plug generally comprising a base member 10, a cover member 12 and an intermediate ring member 14. The base member 10 principally comprises insulating material within which are secured the electrical contacts 16 of the plug. The contacts or blades 16 extend from a front wall of the base 10 and each has at the rear portion a terminal 18 for connecting wires 20 extending within the device in a cable 22 that goes through the cover 12. The base member front wall portion 24 has a first outer cylinder diameter that is greater than the outer cylindrical diameter of the second portion 26 of the base member.

Figure 3:
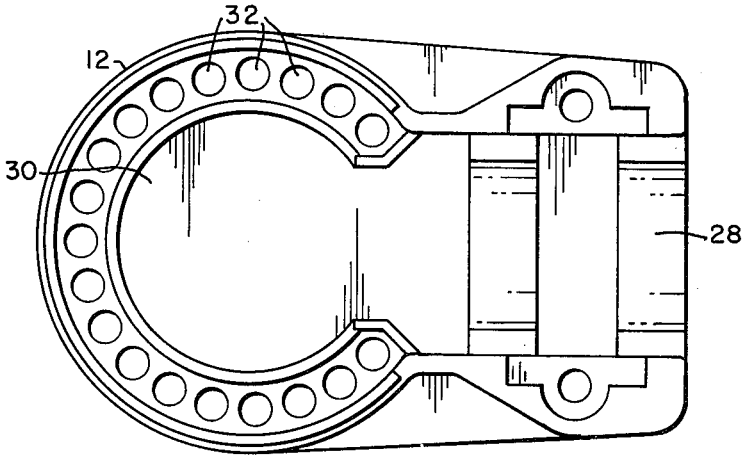
FIG. 3 is a front-elevation view of the cover member of the device of FIGS. 1 and 2.
Figure 2:
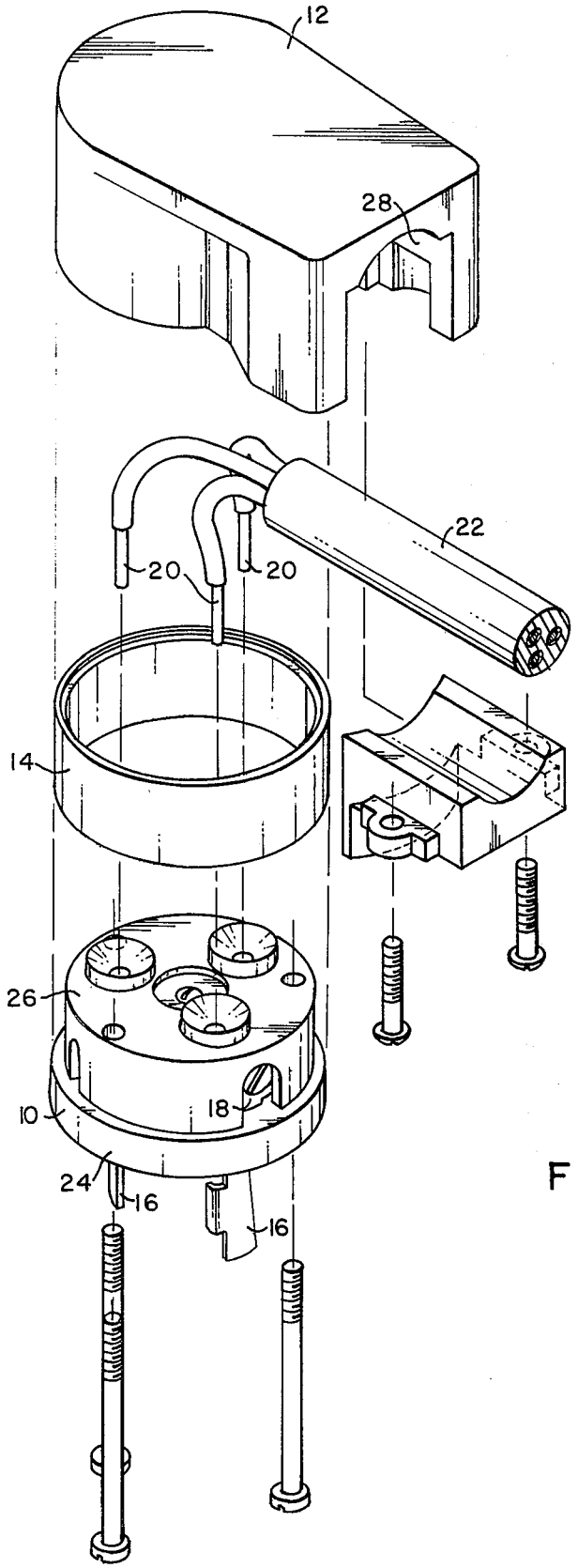
FIG. 2 is a perspective exploded view of the elements of the device of FIG. 1.

The cover 12 is also of insulating material and has an access port 28 for an electrical cable 22 and also a chamber 30 within which conductors in the cable are turned from a direction substantially perpendicular to that of the blades to a diirection aligned with the blades so the conductors of the cable can be joined to the terminals 18. The chamber of the cover, whose interior is shown in FIG. 3, has an inner-cylindrical surface around which is an array of fastener apertures 32 that is continuous except for a portion of the chamber at which the cable is admitted. The fastener apertures are preferably numerous and closely spaced, that is, spaced more closely than their individual diameter. For example, in this example, there are nineteen fastener apertures. This permits one using the plug to merely turn the cover to the angle of interest and then secure the fasteners. Conventional threaded fasteners may be used that cause the apertures to be threaded when applied, i.e., the apertures need not be threaded prior to assembly.

The ring member 14 is a simple cylindrical element having smooth and continuous inner and outer surfaces inside of which is accommodated the bulk portion 26 of the base member 10 while the edges of the ring member abut longitudinally against the face portion 24 of the base member and against the perimeter of the opening to the chamber of the cover member. The outer surfaces of the ring and the housing of the cover and the flat portion of the base are of similar diameter and provide a clean cylindrical surface.

Preferably, the edge 15 of the ring 14 has a groove in it within which a small rim fits that extends from around the perimeter of the opening in the cover. There is not, however, any key between the various elements that locks them into their respective positions other than by the orientation of the fasteners as described. Since there is no requirement of keying onto the base 10 which contains contact elements that body may be the same as that used in longitudinal connectors without the angle feature.

It would appear that the ring could be part of the cover and molded integrally therewith. However, it is believed this would be less convenient for wiring convenience and also would be a relatively weaker section of material than can be afforded by a separately molded ring member.

What is claimed is:

1. An electrical angle plug comprising:

a base member of insulating material with electrical contact elements secured therein and having a front face from which said contact elements extend, said contact elements each having a terminal for wire engagement therewith, said base member having a first cylindrical periphery at said front face and a second cylindrical periphery remote from said front face of lesser diameter than said first periphery, said base member having a plurality of fastener passageways therethrough;

a cover member of insulating material having an access port for admitting a cable in a direction substantially parallel to said front face, said cover member having an interior chamber with a substantially smooth cylindrical surface and with an opening facing said base member and a back wall opposite said opening, said chamber having a plurality of fastener receiving apertures disposed in an arcuate array around said cylindrical surface and against said back wall;

a cylindrical ring member slidably fitting on said second cylindrical periphery of said base member and having an inner-diameter less than said first cylindrical periphery, said ring having an edge abutting against the outside of said chamber opening of said cover, said base being rotatable with respect to said cover to any of a variety of positions;

a plurality of fasteners extending through said base passageways and into a like number of said apertures of said cover for securing said base and said cover in any of said variety of positions, said base, cover and ring members being freely rotatable except as secured by said fasteners.

2. An electrical angle plug in accordance with claim 1 wherein:

said ring has smooth continuous inside and outside surfaces.

3. An electrical angle plug in accordance with claim 2 wherein:

said ring has a grooved edge in which a rim around said chamber opening of said cover fits.

4. An electrical angle plug in accordance with claim 1 wherein: said array of fastener receiving apertures includes a full circle except for a minor arcuate portion where said cable access port enters said chamber and said apertures are spaced more closely then their individual diameter.

5. An electrical angle plug in accordance with claim 1 wherein:

said ring outer diameter is substantially the same as both said base first periphery and the outside of said cover chamber.

* * * * *